US009611695B2

(12) United States Patent
Slaughter, Jr. et al.

(10) Patent No.: US 9,611,695 B2
(45) Date of Patent: Apr. 4, 2017

(54) DUAL PIPE DRILLING HEAD WITH IMPROVED BEARING RETENTION STRUCTURE

(71) Applicant: The Charles Machine Works, Inc., Perry, OK (US)

(72) Inventors: Greg L. Slaughter, Jr., Perry, OK (US); Travis W. Woodson, Orlando, OK (US); Curtis Johnson, Goltry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 286 days.

(21) Appl. No.: 14/252,756

(22) Filed: Apr. 14, 2014

(65) Prior Publication Data

US 2014/0305709 A1 Oct. 16, 2014

Related U.S. Application Data

(60) Provisional application No. 61/811,452, filed on Apr. 12, 2013.

(51) Int. Cl.
*E21B 7/06* (2006.01)
*E21B 7/04* (2006.01)
*E21B 7/00* (2006.01)

(52) U.S. Cl.
CPC ..... *E21B 7/062* (2013.01); *E21B 7/002* (2013.01); *E21B 7/046* (2013.01)

(58) Field of Classification Search
CPC ..... E21B 7/062; E21B 7/002; E21B 7/046
See application file for complete search history.

(56) References Cited

U.S. PATENT DOCUMENTS 2,944,795 A * 7/1960 Le Bus, Sr. ..... E21B 25/00 175/255
5,490,569 A * 2/1996 Brotherton ..... E21B 7/062 175/45
5,803,187 A * 9/1998 Javins ..... E21B 4/02 175/296
RE38,418 E * 2/2004 Deken ..... E21B 6/00 175/19
6,705,415 B1 * 3/2004 Falvey ..... E21B 7/04 175/304

(Continued)

*Primary Examiner* — Nicole Coy
(74) *Attorney, Agent, or Firm* — Tomlinson McKinstry, P.C.

(57) ABSTRACT

A downhole tool assembly for use in directional drilling operations. The assembly has a housing, a chuck, a cutting tool, a hub, and an elongate drive member. The housing has a spindle for supporting the hub and chuck for rotation thereon. The chuck is connected to the hub and has a non-circular interior surface and a box for supporting a cutting tool for rotation with the chuck. The elongate drive member is disposed within the housing, the hub, and the chuck. The drive member is operatively connected to the inner member of a dual-member drill string for rotation independently of the housing. The drive member has a non-circular external surface corresponding to the non-circular interior surface of the chuck. The pin end of the drive is slidably receivable in connector free torque-transmitting engagement with the interior surface of the chuck to drive rotation of the cutting tool, chuck, and hub independently of the housing.

26 Claims, 8 Drawing Sheets

(56) References Cited

U.S. PATENT DOCUMENTS

| | | | | |
|---|---|---|---|---|
| 6,761,231 | B1 * | 7/2004 | Dock | E21B 4/10 175/107 |
| 6,827,158 | B1 * | 12/2004 | Dimitroff | E21B 7/002 175/173 |
| 7,216,724 | B2 * | 5/2007 | Self | E21B 7/046 175/19 |
| 2013/0014992 | A1 * | 1/2013 | Sharp | E21B 47/024 175/45 |
| 2013/0068490 | A1 * | 3/2013 | Van Zee | E21B 7/02 173/1 |
| 2014/0027184 | A1 * | 1/2014 | Slaughter, Jr. | E21B 17/00 175/62 |
| 2016/0084016 | A1 * | 3/2016 | Slaughter, Jr. | F16D 1/033 403/376 |

* cited by examiner

DUAL PIPE DRILLING HEAD WITH IMPROVED BEARING RETENTION STRUCTURE

CROSS REFERENCE TO RELATED APPLICATION

This application claims the benefit of provisional patent application Ser. No. 61/811,452, filed on Apr. 12, 2013, the entire contents of which are incorporated herein by reference.

FIELD

The present invention relates generally to the field of horizontal directional drilling and specifically to tools used with dual-pipe drilling systems.

SUMMARY

The present invention is directed to a horizontal directional drilling system comprising a rotary drilling machine, a drill string, a cutting tool, and a downhole tool assembly. The drill string has a first end and a second end. The first end is operatively connected to the rotary machine to drive rotation of the drill string. The drill string comprises an outer member and an inner member. The inner member is rotatable independently of the outer member. The downhole tool assembly is operatively connected to the second end of the drill string. The assembly comprises a chuck, a hub, housing, and an elongate drive member. The chuck supports the cutting tool to rotate the cutting tool and comprises a non-circular interior surface. The hub is connected to the chuck for rotation with the chuck. The housing comprises a spindle and is operatively connected to the outer member of the drill string for rotation with the outer member of the drill string. The elongate drive member is disposed within the housing and operatively connected to the inner member of the drill string at a first end and comprises a non-circular exterior surface corresponding to the non-circular interior surface of the chuck at the second end. The drive member is slidably receivable in connector-free torque-transmitting engagement with the non-circular interior surface of the chuck to drive rotation of the cutting tool, chuck, and hub independently of the housing.

The present invention is likewise directed to a downhole tool assembly for use in directional drilling operations. The assembly comprises a housing, a chuck, a hub, and a drive member. The housing has a first end and a second end. The first end comprises a connector for connecting the housing to an outer member of a drill string. The second end comprises a spindle. The hub is supported for rotation about the spindle. The chuck is connected to the hub to transmit torque from the chuck to the hub. The chuck comprises a geometrically-shaped internal surface and a box for supporting a cutting tool therein. The elongate drive member is disposed within the housing, the hub and the chuck and operatively connected to an inner member of the drill string for rotation independently of the housing and outer member of the drill string. The drive member has a geometrically-shaped pin end. The pin end of the drive member is slidably receivable in connector-free torque-transmitting engagement with the geometrically-shaped interior surface of the chuck to drive rotation of the cutting tool, chuck, and hub independently of the housing.

DESCRIPTION

Figure 1:
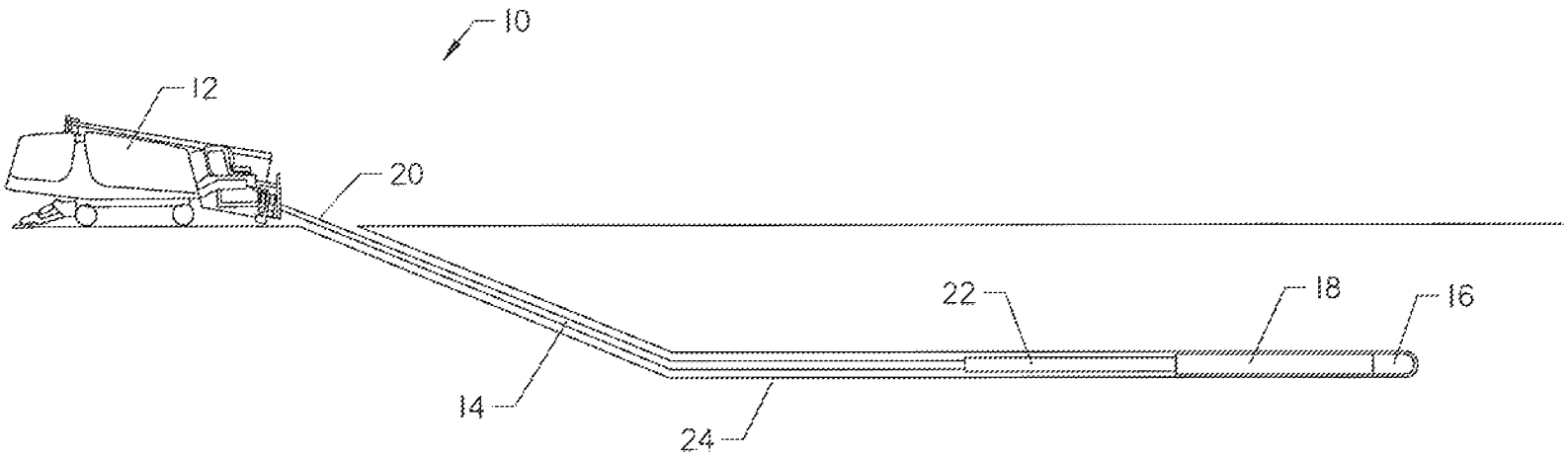
FIG. 1 is diagrammatic representation of a horizontal directional drilling operation using the downhole tool of the present invention.

Directional boring machines are used to drill holes underneath roads and other obstructions for the installation of gas lines, telephone and electrical cable and other utilities. In the past, installing a gas line or electrical cable across, for example a roadway, required excavation of a trench through which the utility line was installed. After installation, the trench was backfilled with appropriate material, such as sand or crushed rock, in a series of stages. A layer of fill material was placed in the trench and tamped down, either manually or with a mechanical tamping device. This process was repeated until the trench was filled to a level close to the surface. At this point, the surface of the roadway would be resurfaced with gravel, asphalt, or concrete, depending upon the particular circumstances.

The development of the horizontal directional drilling has largely eliminated the need to trench across roads or other surface structures. The horizontal directional drilling ("HDD") system 10 comprises a rotary drilling machine 12, a drill string 14, a cutting tool 16, and a downhole tool assembly 18. The drill string 14 generally comprises a series of pipe sections joined end to end at pipe joints. Horizontal directional drills may utilize single member drill strings or dual-member drill strings to create the desired borehole. Drilling machines that use dual-member drill strings are generally considered "all terrain" machines because they are capable of drilling through soft soil as well as rocks and rocky soil. Dual-member drill strings comprise a plurality of dual-member pipe sections. Each dual-member pipe section comprises an inner member supported inside an outer member. The inner member is generally rotatable independent of the outer member. The inner member may be used to rotate the cutting tool 16 to excavate the formation, and the outer member is selectively rotated to align a steering mechanism to change the direction of the borehole while the rotating bit continues to drill. One such system is described in U.S. Pat. No. 5,490,569, entitled Directional Boring Head With Deflection Shoe, the contents of which are incorporated herein by reference. Suitable dual-member drill strings, for use in horizontal directional drilling, are disclosed in U.S. patent application Ser. No. 13/951,797 and U.S. Pat. No. RE38418, both entitled Dual Member Pipe Joint For a Dual Member Drill String, the contents of which are incorporated herein by reference.

One method to connect dual-member drill string pipe sections together is by threading the inner members together and threading the outer members together. Another method is to connect the outer members using a threaded connection and connect the inner member using a non-threaded connection. This may be done by forming the ends of the inner members in a non-threaded geometric shape, such that the geometric-shape of the box end of the inner member corresponds with the geometric-shape of the pin end of a second inner member. The pin end of the inner member may slide axially into the box end of the second inner member to form a connector-free, torque-transmitting connection.

Continuing with FIG. 1, the drill string has a first end 20 and a second end 22. At the first end 20, the inner member and outer member are both operatively connected to the rotary machine 12 to drive rotation of the inner member and the outer member. Accordingly, the rotary drilling machine may comprise an inner drive to drive rotation of the inner members and the cutting tool 16 and an outer drive used to selectively rotate the outer member to position a steering toot on the downhole tool assembly for steering the cutting tool.

The drill string 14 passes through a borehole 24 as the downhole tool 18 is advanced to an exit point. The drill string 14 may be tubular and comprise a fluid passage not shown) that extends between the first end 20 and the second end 22. The fluid passage may be formed in the annular space between the outer member and the inner member of the drill string 14 and may also comprise a passage formed within the inner member. The cutting tool 16 may comprise a drill bit or head configured for boring and typically includes an ejection nozzle for water or drilling mud to assist in boring. The drill bit may be a directional drill bit or a tri-cone drill bit. Alternatively, the cutting tool may comprise a back reamer.

Figure 2:
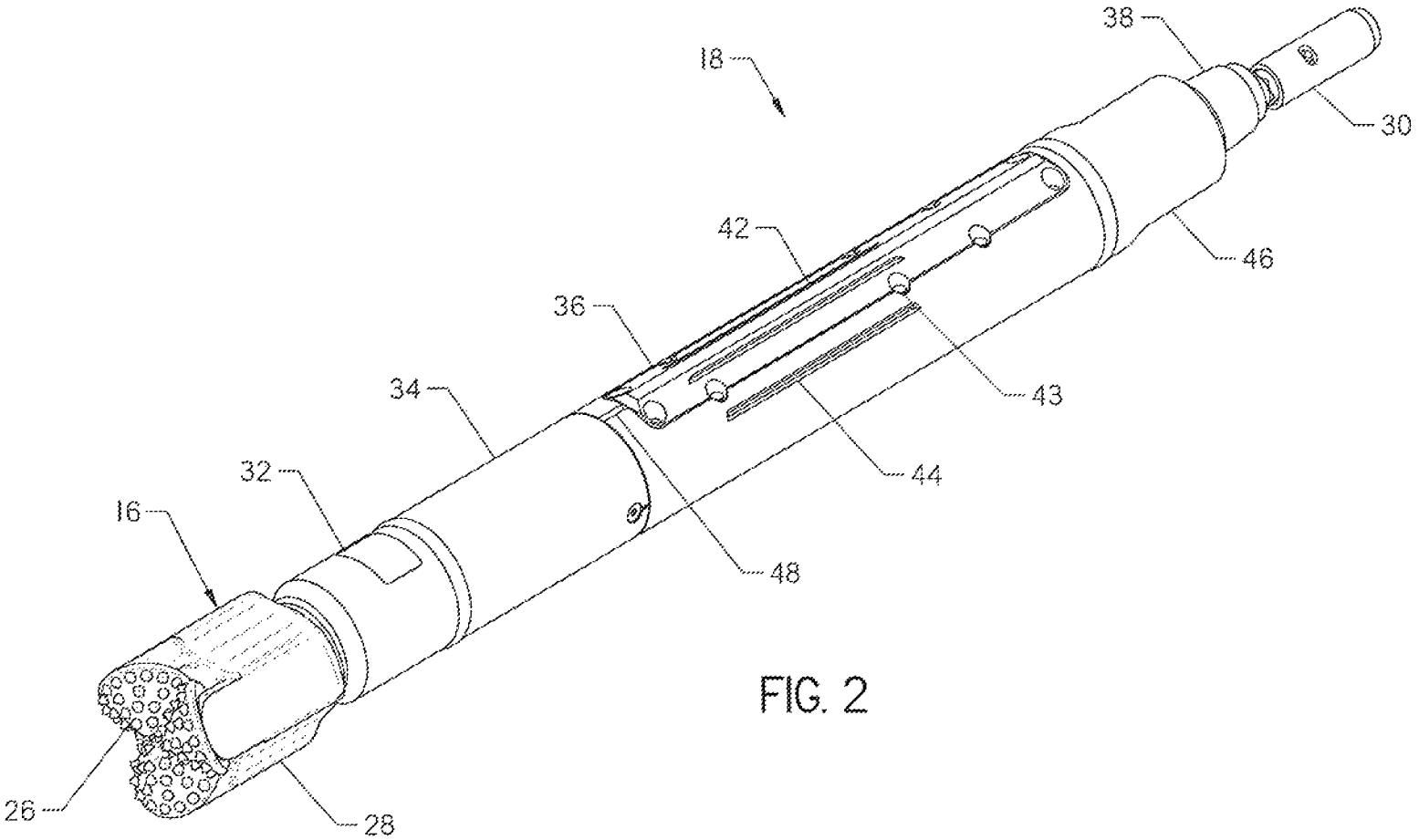
FIG. 2 is an isometric view of the downhole tool of the present invention showing a cutting tool connected to the end of the tool.
Figure 3:
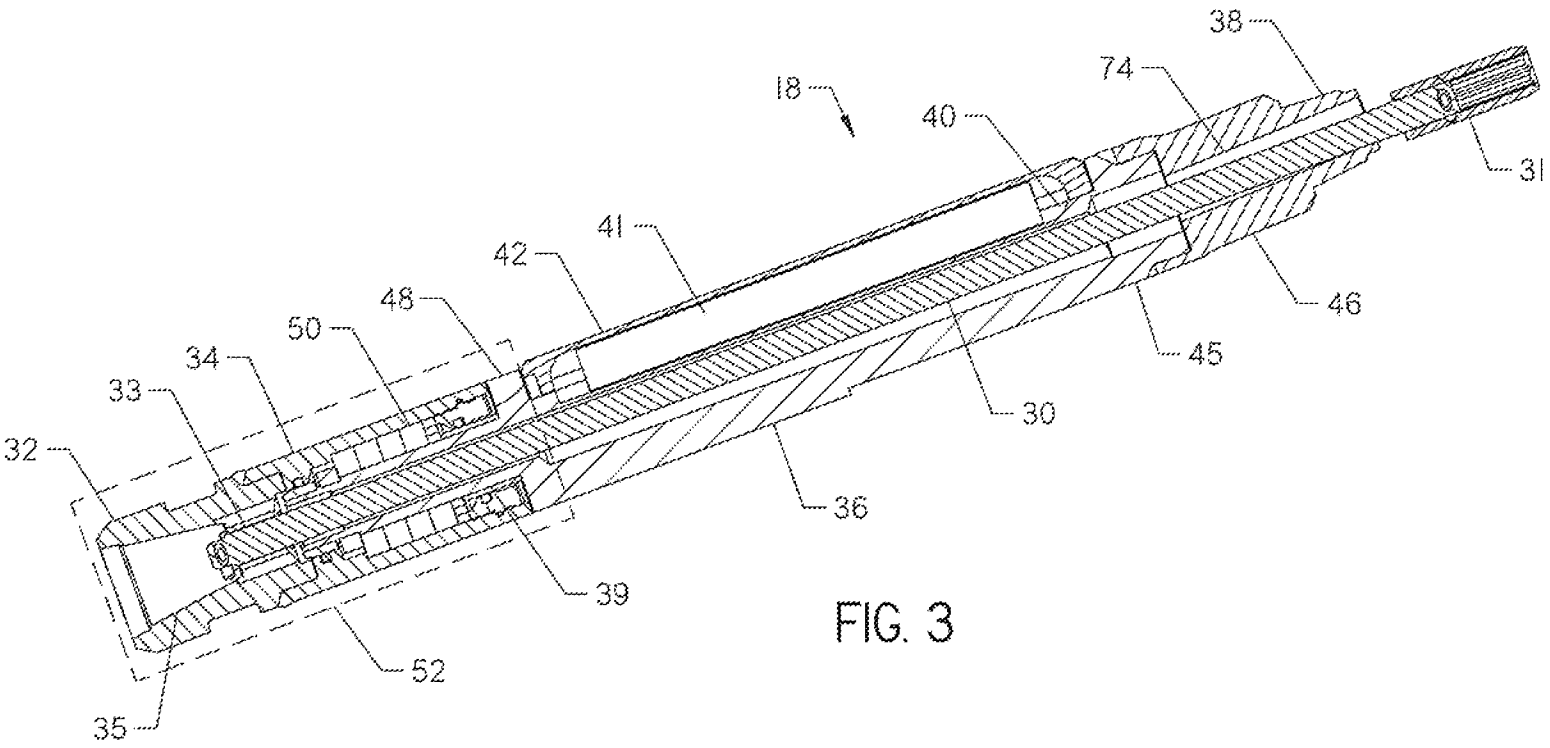
FIG. 3 is an isometric, sectional view of the downhole tool of the present invention with the cutting tool removed.

Turning now to FIGS. 2 and 3, the downhole tool 18 and cutting tool 16 are shown in greater detail. The cutting tool 16 shown in FIG. 2 is a drill bit generally referred to as a tri-cone bit. The bit 16 comprises three roller cones 26 rotatably mounted to a bit body 28. The bit 16 is connected to the downhole tool assembly 18 and rotates in response to rotation of an elongate drive member 30.

The drive member 30 may comprise a connector 31 (FIG. 3) at its first end. The connector 31 operatively connects the drive member 30 to the inner member of the drill string. The connector 31 may comprise slip fit connector box end having a non-circular or geometric-shaped internal surface. The drive member 30 also comprises a non-circular exterior surface 33 at its second end.

Continuing with FIGS. 2 and 3, the downhole tool assembly 18 comprises a chuck 32, a hub 34, and a housing 36. The chuck 32 is connected to the cutting tool 16 to rotate the cutting tool and may comprises a threaded box 35 to receive a threaded pin (not shown) of the drill bit. Chuck 32 will be discussed in more detail with reference to FIG. 4 hereinafter. The hub 34 is connected to the chuck 32 for rotation with the chuck. The hub 34 and the chuck 32 may be threaded together, welded as shown in FIG. 3, or constructed from a single piece.

The housing 36 is generally elongate and comprises a pin end 38, a spindle 39, a beacon housing 40, and an offset sub 46 that includes a steering shoe. The pin end 38 may be threaded for connecting the housing to a correspondingly threaded box end of the outer member of the dual member drill string. The beacon housing 40 is a chamber formed within the housing for supporting downhole electronics such as a beacon 41, also known as a "sonde," used to track and locate the downhole tool assembly 18 and cutting tool 16 during boring operations. The beacon housing 40 is generally offset from the rotational axis of the housing 36 and comprises a cover 42 fastened to the housing with fasteners 43. The cover 42 may also be fastened with pins and tongue-in-groove slots. The housing 36 may also comprise one or more elongate slots 44 cut in the side of the housing. Slots 44 allow electromagnetic signals emitted from the beacon 41 to escape through the steel housing 36.

A steering shoe 45 may be disposed on the side of the housing 36 in a known position relative to the beacon housing 40. The steering shoe 45 is formed by the connection of the housing 36 with the offset sub 46 to form an angle between the longitudinal axis (not shown) of the downhole tool 18 and the longitudinal axis (not shown) of the drill string. The angle of offset is generally between 0.5 and four (4) degrees. The steering shoe 45 provides a reaction surface against the borehole to force the drill bit 16 in the direction opposite the steering shoe. The housing 36 also comprises a slot 48 formed at the downhole end of the housing 36 used for a purpose described hereinafter.

The hub 34 is supported on the spindle 39 for rotation about the spindle. The hub 34 covers a bearing assembly 50. The bearing assembly 50 facilitates rotation of the hub 34 and chuck 32 about the spindle 39 and supports the load applied to the downhole tool assembly by the thrust and rotation motors of the rotary drive machine 12.

Figure 4:
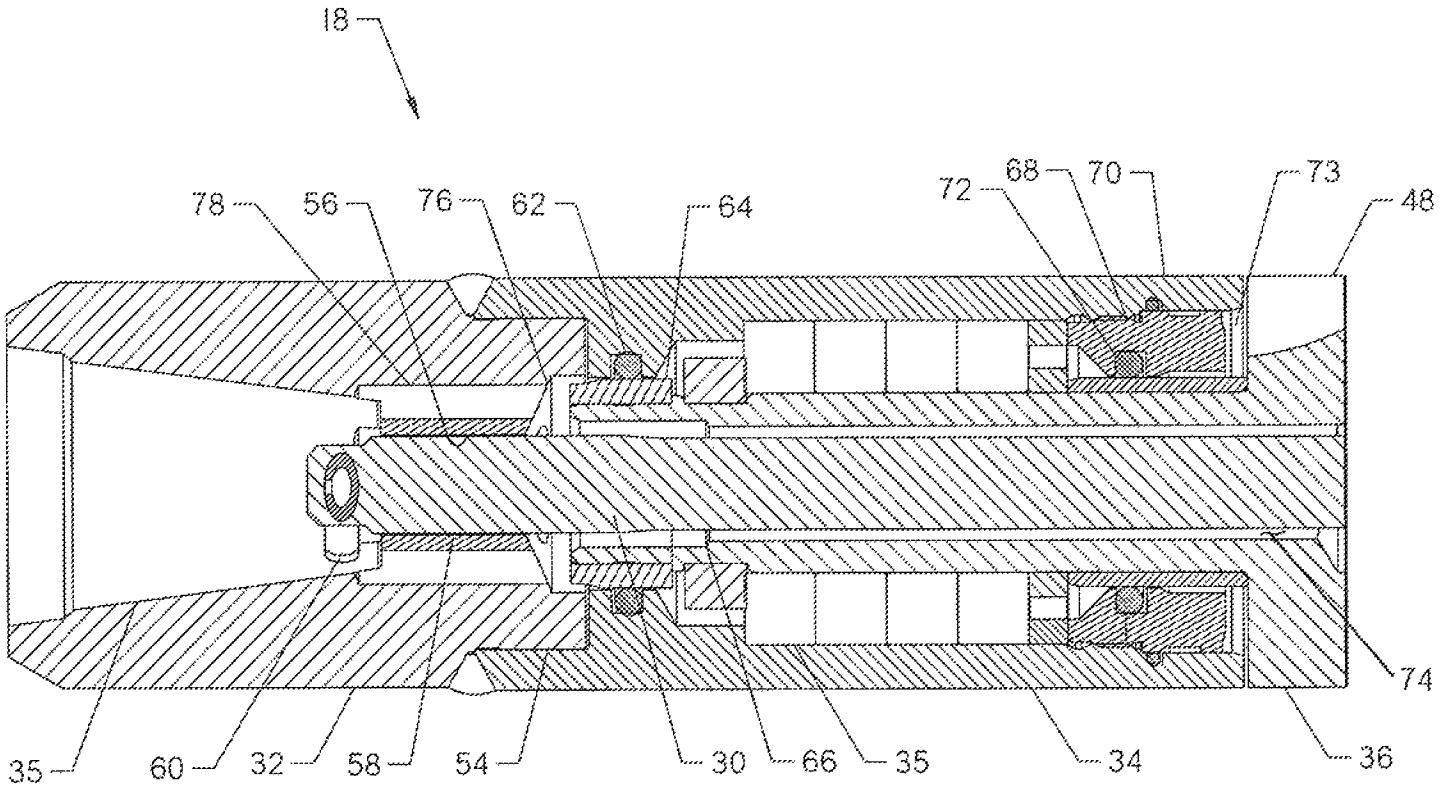
FIG. 4 is a close-up view of the portion of the tool within the dashed box shown in FIG. 3.

Turning now to FIG. 4, a close-up view of a portion of the downhole tool assembly 18 within dashed box 52 (FIG. 3) is shown. FIG. 4 shows the housing 36, the hub 34, and chuck 32. As previously discussed the chuck 32 may comprise a threaded box 35 to receive a threaded pin (not shown) of the cutting tool 16 (FIG. 2) to support the cutting tool 16 for rotation with the chuck. The chuck 32 may be connected to the hub 34 at a weld and a press fit joint 54 or a threaded connection. The chuck 32 comprises a non-circular interior surface 56 corresponding to the non-circular exterior surface 58 of the pin end of the drive member 30. The non-circular surface 58 of the pin end of the drive member 30 is slidably receivable in connector-free torque transmitting engagement with the non-circular interior surface 56 of the chuck 32 to drive rotation of the cutting tool 16, the chuck, and the hub 34 independently of the housing 36. Non-circular surfaces 56 and 58 may be geometrically-shaped. Such surfaces may be hexagonal, octagonal, square, triangular, pentagonal, a Torx-style feature, splined, or any other geometric shape capable of transmitting the desired torque through the feature. Co-pending U.S. patent application Ser. No. 13/951,797, the contents of which are incorporated fully herein, describes several non-circular geometrically-shaped torque transmitting surfaces usable in the present invention. A retaining pin 60 may be inserted through a hole formed at the end of the drive member 30. The retaining pin 60 limits axial movement of the drive member 30 to the right in FIG. 4. Threading the cutting tool 16 (FIG. 2) into box 35 will limit movement of the drive member 30 to the left in FIG. 4.

The hub 34 covers a bearing assembly 50 and distributes thrust forces received from the spindle 39 to the chuck 32 and cutting tool. The bearing assembly 50 is disposed between the spindle 39 and the hub 34 to facilitate rotation of the components relative to one another. A seal 62 and ring 64 are disposed proximate the connection of the chuck 32 to the hub. The seal 62 helps to prevent the migration of cutting spoils or fluids into the space between the spindle 39 and the bearing assembly. Ring 64 maintains the location of the spindle within the hub to help keep fluid passage 66 open during operation. Ring 64 acts as a replaceable wear surface for the seal to wear against should the assembly become worn and need the seal surfaces refurbished. The bearings and the split ring collar 88 maintain the location of the spindle within the hub by capturing the bearings on the spindle 39.

A seal housing 68 may be connected to the uphole end 70 of the hub 34 using a snap ring or locking rig. Alternatively, the seal housing 68 may be threaded to the uphole end 70 of the hub 34. The seal housing 68 comprises a seal 72 used to limit the intrusion of drilling spoils, cuttings, and fluid into the space between the bearing assembly 50 and the spindle 39. The seal housing 68 also comprises a groove 73 accessible through the slot 48 formed in housing 36.

During drilling operations drilling fluid is pumped through the drill string 14 into the fluid passage 74 (FIG. 3) formed by the annular space between the drive member 30 and the interior surface of the housing 36. Referring to FIG. 4, fluid continues to flow along the fluid path 74 to passage 66. Passage 66 conducts the fluid to through a wall 76 formed in the chuck 32 having a plurality of openings 90 (FIG. 5A) that direct the fluid into chuck passages 78. Chuck passages 78 direct the fluid into the box 35 and ultimately through nozzles or holes formed in the cutting tool 16 into the bore 24 (FIG. 1). Thus, the present invention provides a "floating spindle" that does not require the cyclically bending drive member 30 to carry the thrust or pulling loads applied by the drive machine 12 through the outer members of the drill string. The construction of the downhole tool and fluid paths described herein also permit higher flow rates of fluid to the cutting tool 16 through the housing 36 than provided in previous downhole tool assemblies.

Figure 5A:
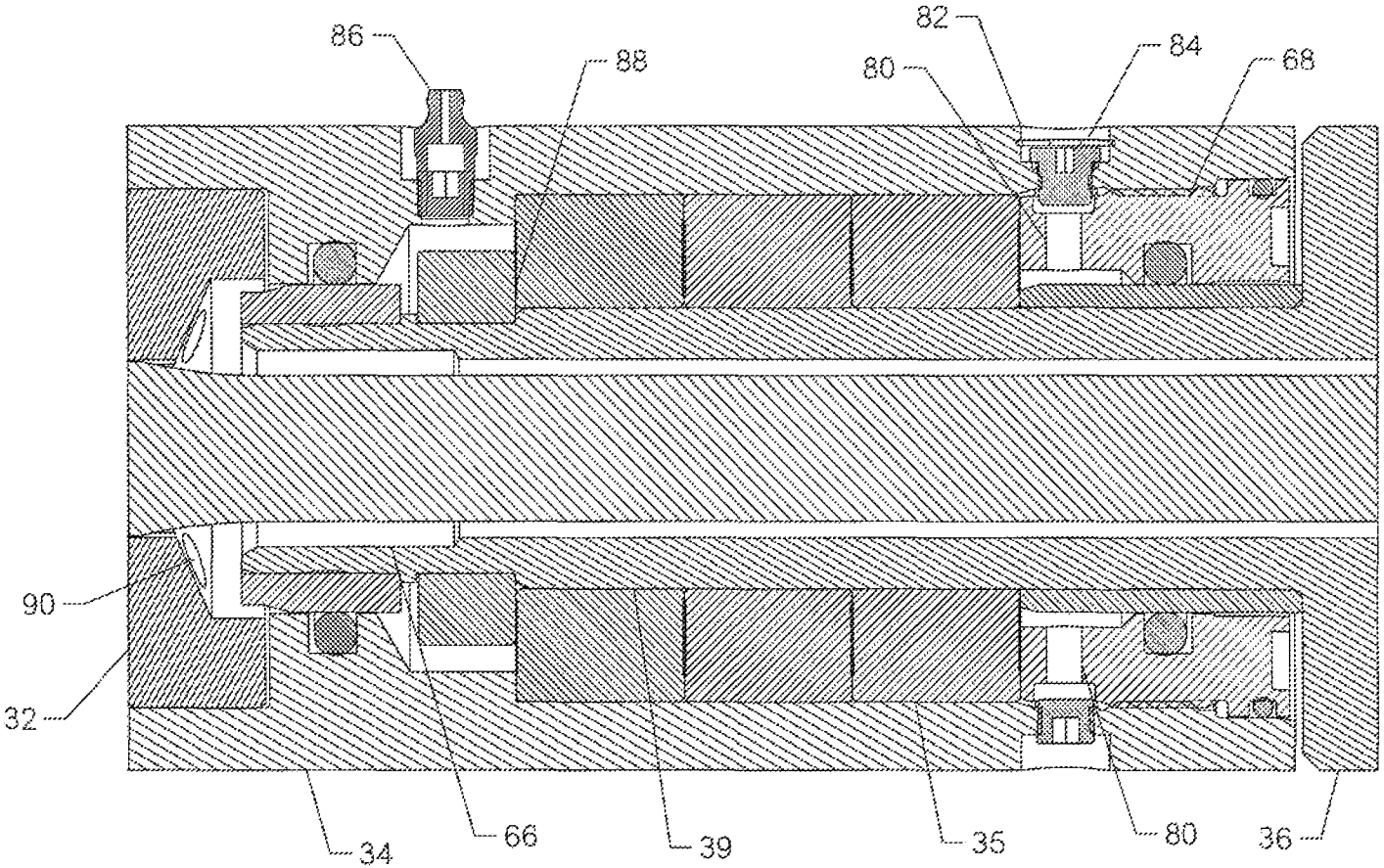
FIG. 5A is a close-up section view of the bearing assembly shown in FIG. 4.

Turning now to FIG. 5A, the hub 34, axle 39, and housing 36 are shown in a detail sectional view. FIG. 5A illustrates how the hub 34 and chuck 32 are retained to prevent disengagement of the hub and chuck from the drive member 30 and housing 36. The seal housing 68 is threaded into the hub 34. A set screw 83 may be threaded into port 79 and engage seal housing 68 to limit rotation of the hub relative to the seal housing. Threaded plug 84 is placed within service port 82 to plug drilled hole 80. Set screw 83 may also be used to plug drilled holes 80. Drilled holes 80 allow communication of grease from grease port 86, across the bearing surfaces, through passages 80 and out ports 82. A snap ring may be positioned within the service port 82 to retain a plug 84 within the port as an additional measure to limit the possibility of disengagement of the seal housing 68 from the hub 34. Alternatively, a simple friction-based set screw may also be used to prevent rotation between the seal housing 68 and hub 34. Service port 86 may be formed proximate a split ring clamping collar 88 and the bearing assembly 50. The service ports described herein provide access to the space between the axle 39 and the bearing surfaces to allow an operator to perform maintenance on the assembly. FIG. 5A also shows fluid passages 90 formed in a wall 76, which are in fluid communication with fluid passages 66 and 78 (FIG. 4).

Figure 6:
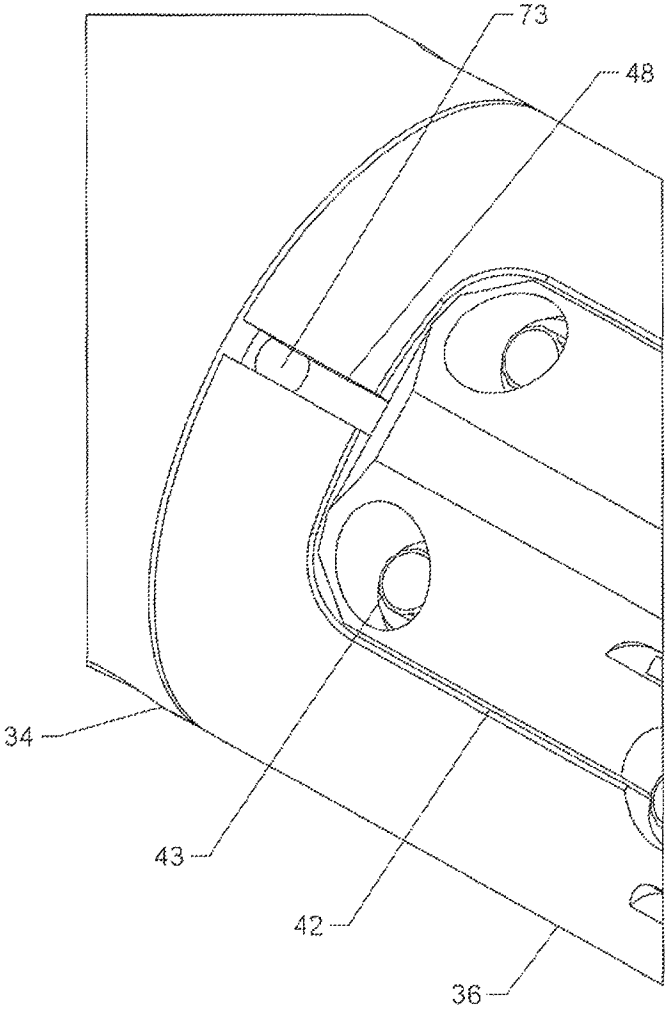
FIG. 6 is a partial view of the tool shown in FIG. 2 showing the hub and the housing in a close-up view.

Turning now to FIG. 6 the exterior of the housing 36, hub 34 and beacon housing door 42 are shown. FIG. 6, illustrates that slot 48 may be aligned with groove 73 under certain conditions.

Figure 5B:
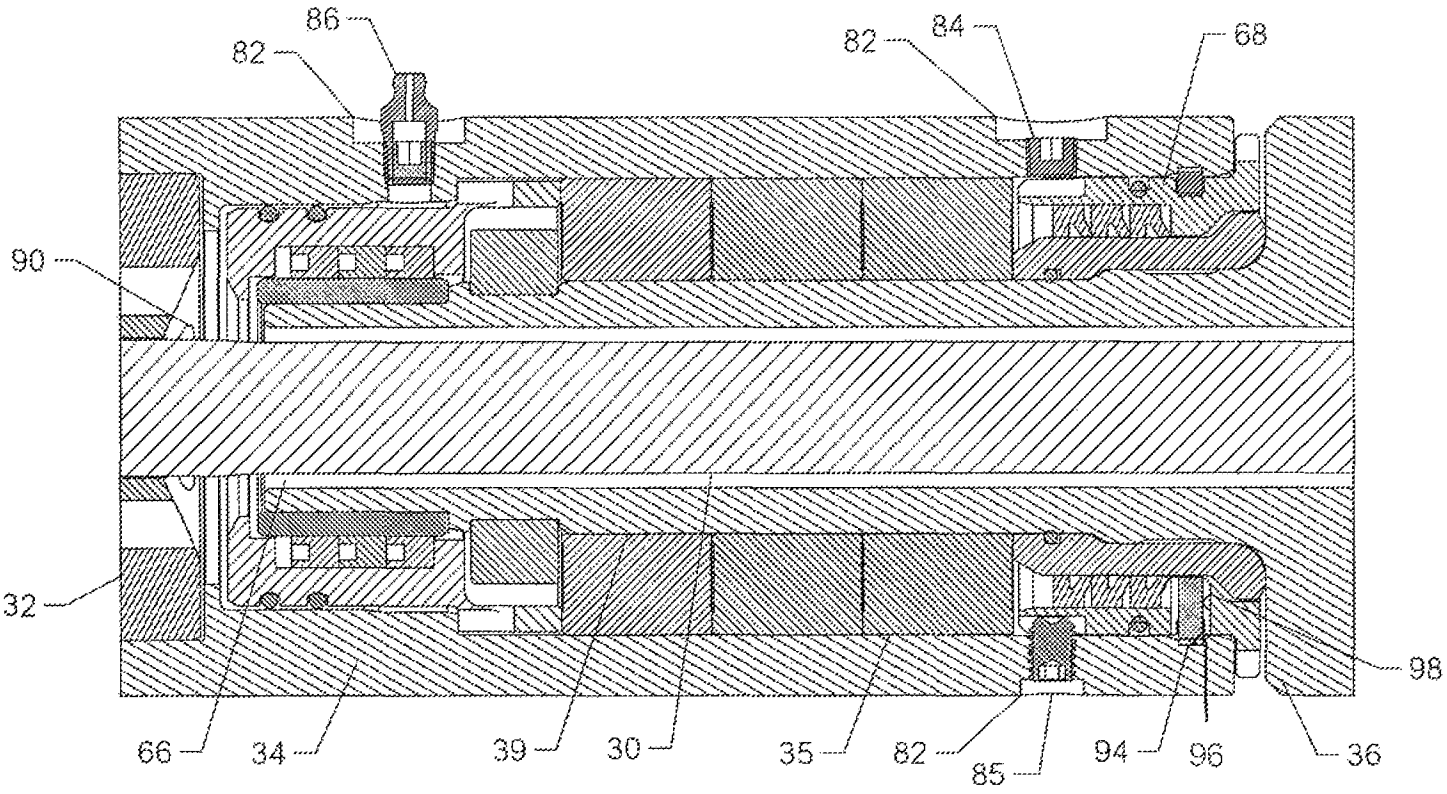
FIG. 5B is an alternative embodiment of the seat housing and hub shown in FIG. 5A.

Referring now to FIG. 5B, an alternative construction for retaining the seal housing with the hub 34 is shown. In FIG. 5B, a wire 94 is shown disposed in a groove 96 formed in the hub 34 opposite a groove 98 formed in the seal housing. In operation, the wire comprises a hook member that hooks to the receiving surfaces on the seal housing and hub. As the seal housing and hub are threaded together the wire 94 is placed into groove 96 and groove 98 about the circumference of the seal housing 68 and the inner surface of the hub 34. The use of wire 94 fastens the seal housing 68 to hub 34.

Figure 7:
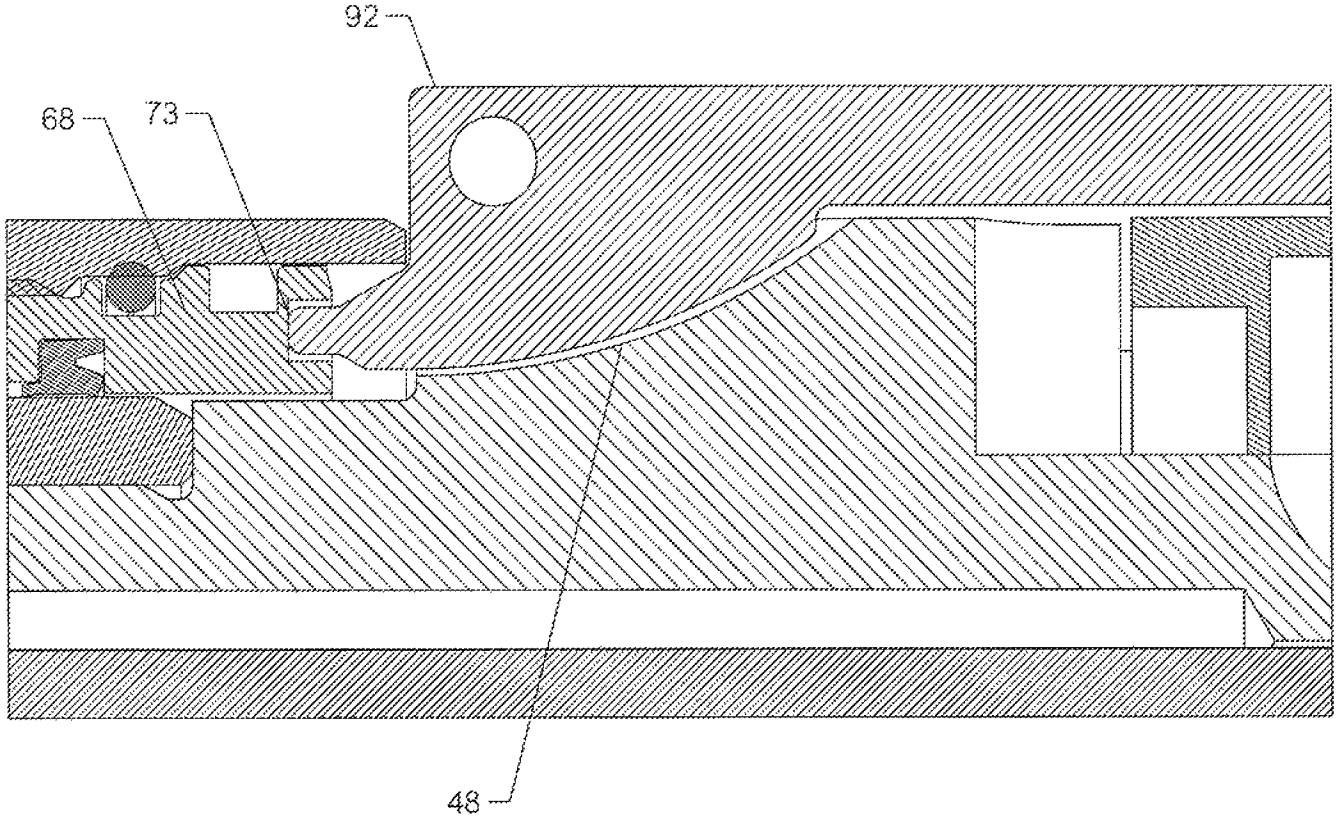
FIG. 7 is a sectional view of the hub and housing shown in FIG. 6.

Referring again to FIG. 5A, to disassemble the hub 34 and seal housing 68, the snap ring used to retain plug 84 is removed from service port 82. The plug 84 is then removed from the service port 82 at the top of the assembly. Next, the set screw 85 in the service port 82 at the bottom of the tool is removed. As shown in FIG. 6, once the plugs 84 have been removed the groove 73 may be aligned with the slot 48. A tool 92 (FIG. 7) may be inserted into the slot 48 and used to engage the groove 73 in the seal housing 68. This allows the operator to disconnect the hub 34 from the seal housing 68 to disassemble the downhole tool assembly.

Various modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

What is claimed is:

1. An assembly comprising:

a hollow first member having opposed first and second ends, the first end has a projecting spindle and the second end is configured to engage an outer member of a drill string;

a drive member situated within the hollow first member for rotation independent of the first member, having opposed first and second ends, in which the first end projects from the spindle and the second end is configured to engage an inner member of a drill string; and a second member positioned over both the spindle and the first end of the drive member, the second member being connected to the drive member for rotation with the drive member.

2. The assembly of claim 1, further comprising a retainer positioned on the first member within the second member and configured to limit longitudinal movement of the second member relative the first member.

3. The assembly of claim 2, in which the retainer has a maximum cross-sectional dimension that exceeds a minimum internal cross-sectional dimension of the second member.

4. The assembly of claim 1, further comprising a cutting member connected to the second member for rotation therewith.

5. The assembly of claim 1, in which the first end of the drive member has a non-circular outer profile and the second member has a non-circular inner profile that interlocks with the non-circular outer profile of the drive member.

6. The assembly of claim 1, in which the spindle has a maximum outer diameter that is smaller than a minimum inner diameter of the second member.

7. The assembly of claim 6, in which the second member comprises a hub connected to a chuck.

8. The assembly of claim 1 in which the second member has opposed first and second ends and in which a seal housing is positioned within the second end of the second member and mounted for rotation about the spindle with the second member.

9. The assembly of claim 8, further comprising:

a retainer positioned on the first member within the second member and configured to limit longitudinal movement of the second member relative the first member; and a bearing assembly positioned within the second member to engage the spindle and bound by the retainer and the seal housing.

10. The assembly of claim 8, comprising a tool member positioned to couple the seal housing and the first member for rotation together.

11. The assembly of claim 1 comprising a pin positioned at the first end of the drive member and configured to limit longitudinal movement of the drive member relative the second member.

12. The assembly of claim 1 comprising a locating beacon supported by the first member.

13. The assembly of claim 1, in which the first member has a shoulder positioned to limit longitudinal movement of the second member relative the first member.

14. A system comprising:

a drill string having a first end and a second end, comprising an outer drive train and an inner drive train, the inner drive train rotates independent of the outer drive train;

a horizontal directional drilling machine operatively engaged to the drill string at its first end; and the assembly of claim 1 operatively engaged to the second end of the drill string such that the first member is operatively connected to the outer drive train and the second member is operatively connected to the inner drive train.

15. The system of claim 14, further comprising a cutting member connected to the second member for rotation therewith.

16. A kit, comprising:

an elongate first member having opposed first and second ends and an end-to-end hollow region, the second end is configured for connection to an outer member of a drill string and the first end forms a spindle having a maximum cross-sectional dimension that is smaller than a cross-sectional dimension of the second end;

a drive member supported within the hollow region of the first member for rotation independent of the first member and having opposed first and second ends, in which the first end projects from the spindle and the second end is coupled to an inner member of a drill string; and a second member positioned over the spindle and coupled to the first end of the drive member for rotation with the drive member.

17. The kit of claim 16 further comprising a retainer supported by the spindle within the second member and configured to limit longitudinal movement of the second member relative the first member.

18. The kit of claim 16, in which the second member comprises a hub and a chuck fixed together end-to-end for rotation together and in which the drive member projects from the hub into the chuck.

19. The kit of claim 18, in which the chuck is configured for connection to a drill bit.

20. The kit of claim 19, in which an interior profile of the chuck is configured to engage a polygonal outer profile of the drive member to transmit torque from the drive member to the hub and the drill bit.

21. The kit of claim 16, in which the second member has opposed first and second ends, and in which the first end is configured for connection to a drill bit and the second end is configured to engage a shoulder of the first member.

22. The kit of claim 16, in which the second member has opposed first and second ends, and in which the first end is configured for connection to a drill bit and the second end is configured to support a seal housing inside the second member for rotation therewith.

23. The kit of claim 22, in which a bearing assembly is supported inside the second member by the spindle and bound by the seal housing and the retainer.

24. The kit of claim 16, in which the first member comprises a beacon housing.

25. An adapter for securing a downhole tool to a dual-pipe drill string, comprising:

a rotatable inner drive system comprising:

a hollow first member configured to engage the downhole tool in a rotationally locked relationship;

an elongate rotatable drive member configured to engage the inner pipe of the dual-pipe drill string at one end and configured to engage the first inner member in a rotationally locked relationship at or near its opposite end; and an outer drive system, rotatable independently of the first drive system, comprising:

a rotatable second member configured to engage the outer pipe of the dual-pipe drill string at one of its ends in a rotationally locked relationship and having at its opposite end a projecting spindle that extends within the first member.

26. The adapter of claim 25 in which the second member has a non-uniform cross-sectional profile along its length, with the profile having its minimum dimension at the projecting spindle.

* * * * *